US007134913B1

(12) United States Patent
Hasircoglu et al.

(10) Patent No.: US 7,134,913 B1
(45) Date of Patent: Nov. 14, 2006

(54) CONNECTOR ASSEMBLY WITH MATING GUIDE SURFACES

(75) Inventors: Alexander W Hasircoglu, Columbia, PA (US); James Lee Fedder, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/111,622

(22) Filed: Apr. 21, 2005

(51) Int. Cl.
*H01R 9/03* (2006.01)

(52) U.S. Cl. ..... 439/610

(58) Field of Classification Search ..... 439/607–610, 439/378, 374, 701, 74, 680, 681, 540.1, 541.5, 439/372, 573
See application file for complete search history.

(56) References Cited

U.S. PATENT DOCUMENTS 5,500,788 A * 3/1996 Longueville et al. ..... 361/800
5,522,731 A * 6/1996 Clark et al. ..... 439/108
6,099,351 A * 8/2000 Wu ..... 439/607
6,102,747 A 8/2000 Paagman
6,213,813 B1 * 4/2001 Huang ..... 439/607
6,428,344 B1 8/2002 Reed
6,435,897 B1 * 8/2002 Paul et al. ..... 439/374
2002/0081874 A1 6/2002 Kumamoto et al.

* cited by examiner

*Primary Examiner*—Ross Gushi

(57) ABSTRACT

A shroud is provided for an electrical connector having a plug interface for mating with a plug assembly and a component interface engaging an electrical component. The shroud includes a body having side walls defining a connector cavity configured to house the connector therein, wherein the side walls engage the connector. A plug opening is defined by a guide surface, and the opening provides access to the connector cavity and defines a mating window that is larger than the plug interface of the connector. A component surface extends substantially parallel to and spaced apart from the plug opening. The component surface is configured to engage the electrical component when the shroud is secured to the component.

9 Claims, 4 Drawing Sheets

CONNECTOR ASSEMBLY WITH MATING GUIDE SURFACES

BACKGROUND OF THE INVENTION

This invention relates generally to electrical connectors, and more specifically to cable connector assemblies with mating guide surfaces.

Modern electronic systems such as telecommunications systems and computer systems often include large circuit boards called backplane boards which are rack mounted or retained in cabinets and are electrically connected to a number of smaller circuit boards called daughter cards. Electrical connectors establish communications between the backplane and the daughter cards, and other electronic devices within the system.

As more functionality is added to electronic systems and as electrical components become more miniaturized, the demand for circuit board interfaces with multiple interface connections has increased. Typically, the backplane or daughter cards included within these systems have multiple electrical connectors for transmission of high speed signals, low speed signals, power, etc. that are transferred to the various components of the system. At least some known electrical systems include multiple connectors arranged in a vertically stacked or horizontally aligned relationship along a single circuit board, wherein each of the connectors is configured to mate with a corresponding plug assembly. These electrical systems provide the connectors in a close relationship. Generally, the connectors are difficult to reach once the connectors are installed, as the connectors may be positioned in the back of the cabinet housing the circuit board. As such, mating the plug assemblies with the connectors can be difficult, as the plug assembly must be properly aligned with the connector prior to mating. Additionally, some connectors require large forces to be applied to mate or remove the plug assembly with the connector, thus providing stress to the components and possible damage or fatigue to the connector if the plug assembly is not properly aligned.

Additional challenges are produced by the increasing speeds and density of signals transmitted across circuit board interfaces in some electrical systems. In systems of this type, shielding of the signals is a growing concern. In at least some known systems, the plug assemblies are coupled to a shielded cable having a cable braid terminated to a conductive shell of the plug assembly. While a satisfactory mechanical and electrical connection between the cable braid and the shells may result from such a construction, issues still remain with shielding along the mating interface of the plug assembly and the connector.

BRIEF DESCRIPTION OF THE INVENTION

In one aspect, a shroud is provided for an electrical connector having a plug interface for mating with a plug assembly and a component interface engaging an electrical component. The shroud includes a body having side walls defining a connector cavity configured to house the connector therein, wherein the side walls engage the connector. A plug opening is defined by a guide surface, and the opening provides access to the connector cavity and defines a mating window that is larger than the plug interface of the connector. A component surface extends substantially parallel to and spaced apart from the plug opening. The component surface is configured to engage the electrical component when the shroud is secured to the component.

Optionally, the guide surface may include a chamfered surface defining a guide window to accommodate a predetermined amount of misalignment of said plug assembly, or the guide surface may be inwardly sloped from an outer edge of the body to define the mating window. A keying channel may extend from an exterior surface of the body, and the keying channel may include an opening for accessing the keying channel. The plug assembly may engage the keying channel prior to engaging the guide surface during installation. Optionally, a retention plate may be coupled to the body for preventing movement of the shroud with respect to the electrical component.

In another aspect, a connector assembly for an electrical component is provided including an electrical connector having a plurality of contacts defining a plug interface. A shroud is separately provided from the connector and surrounds the electrical connector. The shroud includes an opening defined by at least one guide surface, wherein the opening provides access to the plug interface of the plurality of contacts. A plug assembly is mounted to and engages the electrical connector. The plug assembly includes a shell surrounding a plurality of wafers, wherein each wafer includes a contact interface for engaging the plurality of contacts along the plug interface. The shell engages the at least one guide surface when the plug assembly is mounted to the receptacle assembly.

In yet another aspect, an electronic package is provided including a circuit board, and a receptacle assembly. The receptacle assembly has a connector coupled to the circuit board and a shroud separately provided from the connector and surrounding the connector. The shroud has a preliminary guide surface and a secondary guide surface, and the connector includes a plurality of contacts defining a contact interface. The at least one guide surface is proximate the contact interface. A retention plate is coupled to the shroud and retains the shroud against the circuit board. A plug assembly is mounted to and engages the receptacle assembly. The plug assembly includes a plurality of wafers, a shell surrounding the wafers, and a ground shield coupled to the shell. The ground shield engages the retention plate when the plug assembly is mounted to the receptacle assembly. Each wafer has a contact interface for engaging the plurality of contacts when the plug assembly is mounted to the receptacle assembly.

DETAILED DESCRIPTION OF THE INVENTION

Figure 1:
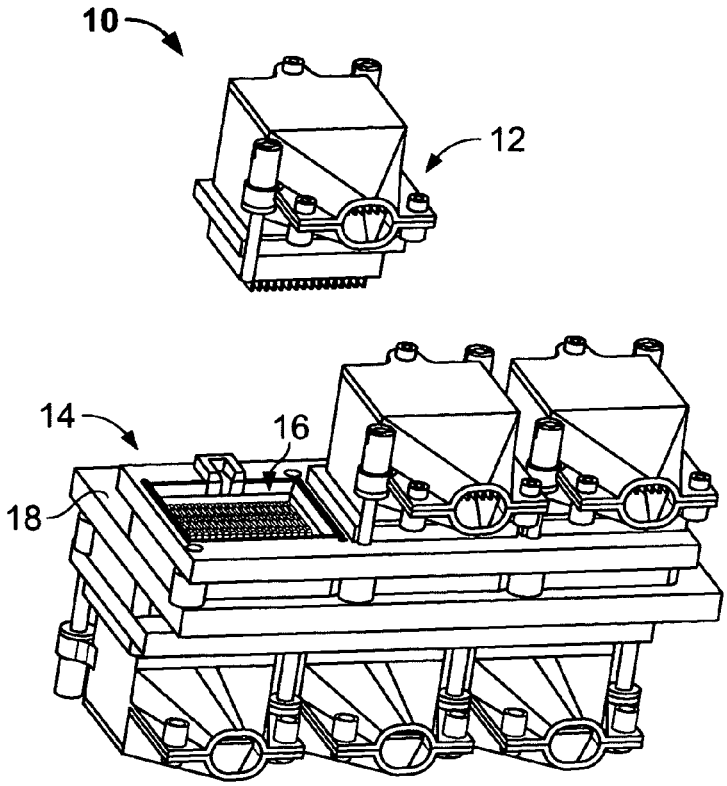
FIG. 1 is an assembly view of a cable connector assembly formed in accordance with an exemplary embodiment of the present invention.

FIG. 1 is an assembly view of a cable connector assembly 10 formed in accordance with an exemplary embodiment of the present invention. The cable connector assembly 10 includes a plug assembly 12 and a receptacle assembly 14. The assemblies 12 and 14 are mated to one another along a mating interface 16, thus forming an electrical connection therebetween. Additionally, the receptacle assembly 14 may be connected to an electrical component mounted in, for example, a computer server system, prior to mating with the plug assembly 12. In one embodiment, the electrical component may be a circuit board 18, such as a backplane or a daughter card. In one embodiment, the plug assembly 12 is a male connector and the receptacle assembly 14 is a female connector.

The plug assembly 12 is particularly useful with shielded cables as explained below, and may be coupled to a shielded cable in a direct and reliable manner which avoids difficulties and disadvantages of known cable connectors when used with shielded cables. Additionally, the receptacle assembly 14 is particularly useful with high speed connectors rated in different rating tiers and capable of carrying signals, such as at or near 2.5 GHz (Tier 1), 5 GHz (Tier 2), 10 GHz (Tier 3), and the like. Optionally, the receptacle assembly 14 may be used with power connectors. However, the cable connector assembly 10 is not intended to be limited to these particular applications.

Figure 2:
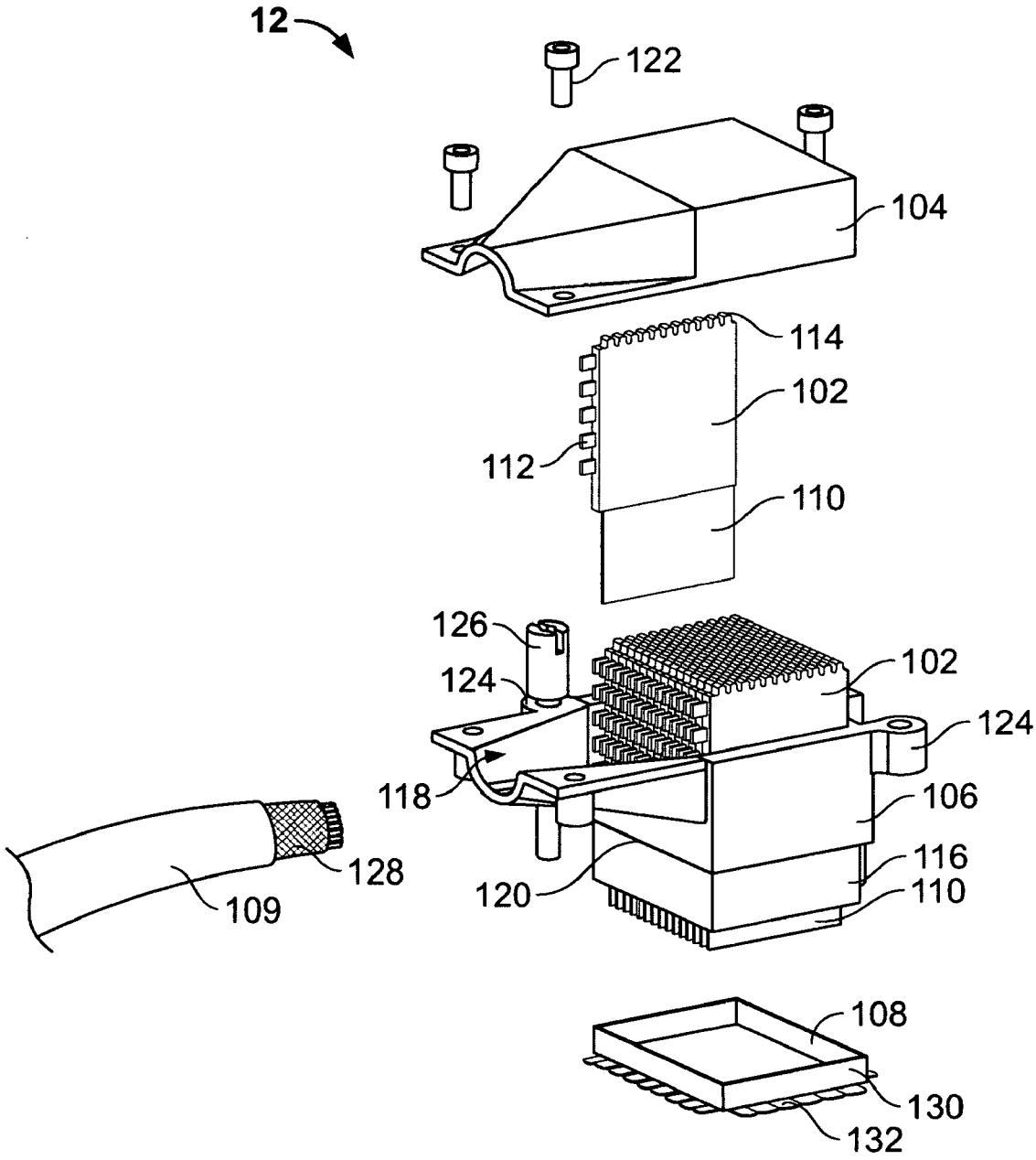
FIG. 2 is an exploded view of a plug assembly forming a portion of the cable connector assembly shown in FIG. 1.

FIG. 2 is an exploded view of the plug assembly 12. The plug assembly 12 includes a plurality of overmolded wafers 102, upper and lower shells 104 and 106, and a ground shield 108. In one embodiment, the plug assembly 12 is connected to a cable 109, and the wafers 102 are mechanically and electrically connected or terminated to conductors in the cable 109 in a known manner. As such, and in an exemplary embodiment, the wafers 102 provide interconnection of high-speed signals between the cable 109 and the receptacle assembly 14 (shown in FIG. 1).

The wafers 102 each include a contact interface 110 for engaging the receptacle assembly 14, as described in detail below. Additionally, the wafers 102 each include conductor terminals 112 for electrically connecting the wafers 102 to the conductors of the cable 109. Signals are transmitted from the conductor terminals 112 to the contact interface 110, thus providing the connection between the cable 109 and the receptacle assembly 14 when the connector assembly 10 is assembled. Additionally, the wafers 102 may include teeth 114 along one edge of the wafers 102 for securing the wafers 102 within the upper shell 104, as will be described in detail below.

In an exemplary embodiment, each of the upper and lower shells 104 and 106 are fabricated from a conductive material, such as die cast metal. The shells 104 and 106 form a protective enclosure about the wafers 102 and the cable conductors when the shells 104 and 106 are coupled to one another. The upper and lower shells 104 and 106 are generally rectangular in shape and are sized and dimensioned to securely receive and retain the wafers 102 and orient the wafers 102 for mating with the receptacle assembly 14.

In an exemplary embodiment, the lower shell 106 includes a wafer holder 116 for receiving and aligning the wafers 102 within the plug assembly 12. The wafer holder 116 isolates the wafers 102 from the conductive body of the lower shell 106. The lower shell 106 also includes a transition area 118 for orienting the cable conductors with respect to the wafers 102. Specifically, the conductor terminals 112 of the wafers 102 are oriented proximate the transition area 118 such that the cable conductors may be terminated to the conductor terminals 112. Additionally, each contact interface 110, as well as the wafer holder 116, extends through a bottom portion 120 of the lower shell 106.

The upper shell 104 defines a cover for the plug assembly 12. The upper shell 104 may include a plurality of notches (not shown) for engaging the teeth 114 of the wafers 102. As such, the upper shell 104 secures the wafers 102 within the plug assembly 12 and reduces movement of the wafers 102 during handling of the plug assembly 12. During assembly, the upper shell 104 is fitted over and mechanically connected to the lower shell 106 with known fastener elements 122, such as screws or rivets. The upper and lower shells 104 and 106 are formed with mounting flanges 124 which receive mounting fasteners 126, such as jack screws. It is recognized, however, that other types of mounting fasteners 126 may be employed in other embodiments to mount the plug assembly 12 in a predetermined location. The plug assembly 12 can be securely mated, via the mounting fasteners 126, to the receptacle assembly 14, as described in detail below.

In an exemplary embodiment, the plug assembly 12 may be electrically common with the cable 109 by attaching a conductive metalized braid 128 of the cable 109 to the conductive shells 104 and 106. Specifically, during assembly, the cable braid 128 is terminated within the transition area 118, and may be secured thereto when the upper and lower shells 104 and 106 are connected to one another.

The ground shield 108 is fabricated from a conductive material and may be stamped to have a predetermined shape. Alternatively, the ground shield 108 may be a metalized gasket. In an exemplary embodiment, the ground shield 108 includes a frame 130 that is generally rectangular in shape and is sized and dimensioned to engage the bottom portion 120 of the lower shell 106, and thus be electrically common with the lower shell 106. However, in an exemplary embodiment, the ground shield 108 is separated from the wafers 102 by the wafer holder 116 to electrically isolate the wafers 102 from the ground shield 108. As such, the ground shield 108 provides electromagnetic interference (EMI) shielding or radio frequency interference (RFI) shielding, as well as, grounding of the plug assembly 12. Moreover, the ground shield 108 includes grounding fingers or tabs 132 which extend outwardly from the frame 130 to contact an outer surface of the receptacle assembly 14, as described below in detail.

Figure 3:
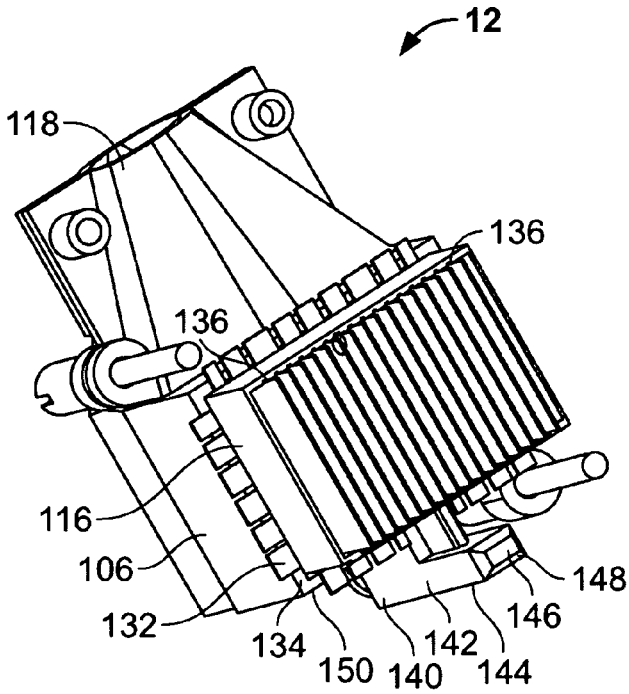
FIG. 3 is a bottom perspective view of the plug assembly shown in FIG. 2 in an assembled state.

FIG. 3 is a bottom perspective view of the plug assembly 12. In an illustrative embodiment, the frame 130 (shown in FIG. 2) of the ground shield 108 is positioned between the exterior walls of the lower shell 106 and the wafer holder 116. Additionally, the grounding tabs 132 abut an alignment ledge 134 of the bottom portion 120 of the lower shell 106. As illustrated in FIG. 3, the wafer holder 116 includes a plurality of positioning slots 136 for positioning the contact interfaces 110 of the wafers 102.

In an exemplary embodiment, the plug assembly 12 includes a keying post 140 extending outward from the lower shell 106. The keying post 140 provides a keying feature for guiding the plug assembly 12 into position as it is mated with the receptacle assembly 14 (shown in FIG. 1). The keying post 140 is generally rectangular in shape and includes longitudinal and lateral side walls 142 and 144, respectively. Additionally, the keying post 140 includes a bottom surface 146 and chamfered edges 148 extending therebetween. The chamfered edges 148 function as guide surfaces for the keying post 140 during assembly and mating of the assemblies 12 and 14. As a result, the keying post 140 allows for blind mating of the plug and receptacle assemblies 12 and 14.

In an illustrative embodiment, the keying post 140 extends from a side wall 150 of the lower shell 106 generally opposed from the transition area 118. By extending outward from the side wall 150, the keying post 140 is positioned outside of the footprint of the cable connector assembly 10. As a result, and as will be described in detail below, the keying post 140 allows for tighter stacking of cable connector assemblies 10 (shown in FIG. 1).

Figure 4:
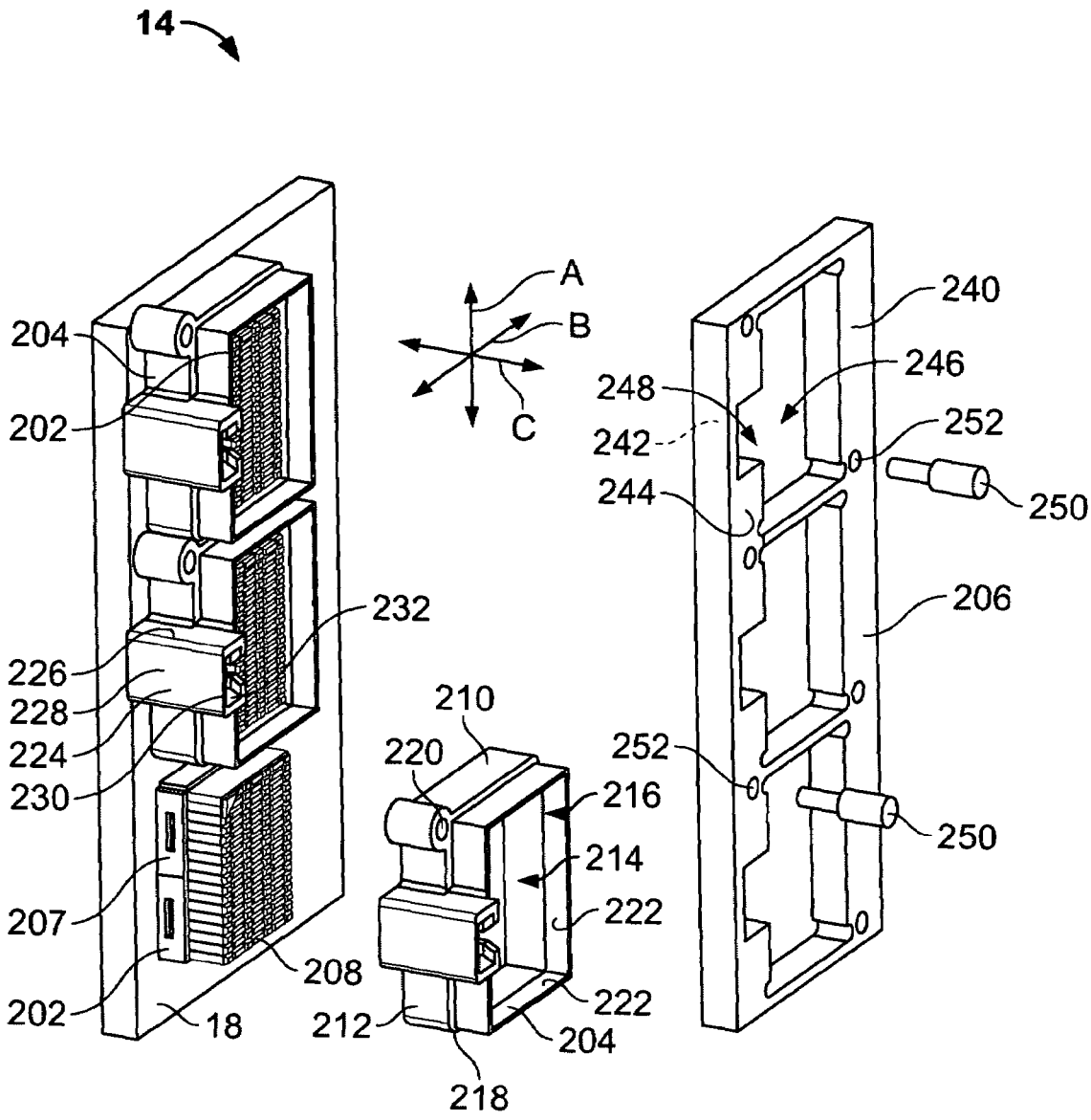
FIG. 4 is a partially assembled view of a receptacle assembly forming another portion of the cable connector assembly shown in FIG. 1.

FIG. 4 is a partially assembled view of the receptacle assembly 14. The receptacle assembly 14 includes a number of connectors 202 each having a shroud or housing 204 surrounding the connectors 202, and a retention plate 206 for securing the shroud 204 to the circuit board 18. In an exemplary embodiment, a plurality of connectors 202 are arranged together in a stacked configuration along the circuit board 18 (shown in FIG. 1) and are retained in place using the shrouds 204 and the single retention plate 206. In one embodiment, the circuit board 18 may extend substantially vertically and the connectors 202 are vertically stacked. In another embodiment, the circuit board 18 may extend substantially horizontally and the connectors 202 are horizontally aligned. In an exemplary embodiment, the connectors 202 are closely stacked such that adjacent shrouds 204 contact one another. As a result the amount of board space used for the receptacle assembly 14 is reduced. In the illustrated embodiment, three connectors 202 and corresponding shrouds 204 are arranged together and retained by a single retention plate 206. However, in alternative embodiments, more or less than three connectors 202 and corresponding shrouds 204 may be arranged on the circuit board 18 and more or less than three connectors 202 and corresponding shrouds 204 may be retained by the retention plate 206. In another alternative embodiment, multiple receptacle assemblies 14 may be utilized on a single circuit board 18.

In an exemplary embodiment, the connector 202 may be connected to the circuit board 18 in a known manner. The connector 202 includes a connector housing 207 surrounding a plurality of contacts 208 arranged in rows to receive the wafers 102 (shown in FIG. 2) during mating with the plug assembly 12. In one embodiment, the connector 202 is a high speed connector, such as a backplane connector, that provides interconnection of high-speed signals between the circuit board 18 and the plug assembly 12. Specifically, the contacts 208 provide the interconnection between the wafers 102 and the circuit board 18. Optionally, the signals may be rated in different rating tiers and capable of carrying signals, such as at or near 2.5 GHz (Tier 1 connector), 5 GHz (Tier 2 connector), 10 GHz (Tier 3 connector), and the like.

The shroud 204 surrounds the connector 202 and provides a guidance window for mating the plug assembly 12 to the connector 202. In one embodiment, the shroud 204 engages the connector housing 207 for retaining the connector housing 207 during handling, transportation, or use of the receptacle assembly 14. In an exemplary embodiment, the shroud 204 is fabricated from an insulative material such as, for example, plastic, thus reducing the overall cost of the receptacle assembly 14. Optionally, the shroud 204 may be metalized to provide an electrical connection along a predetermined portion of the shroud 204, such as, for example, to provide a grounding path between the plug assembly 12 and the circuit board 18 when assembled. The shroud 204 has a generally rectangular shape and includes opposing lateral side walls 210 and opposing longitudinal side walls 212 defining a connector cavity 214 therebetween. An opening 216 extends through the top portion of the shroud 204 allowing access to the connector 202. Specifically, during assembly, the plug assembly 12 is inserted through the opening 216 and is mated with the connector 202. Additionally, a ledge 218 extends along each of the side walls 210 and 212. The ledge 218 supports and interfaces with the retention plate 206 when the receptacle assembly 14 is assembled. Optionally, the shroud 204 may include fastener bores 220 which receive fastener elements (not shown) for securing the shrouds 204 to the circuit board 18.

In an exemplary embodiment, the shroud 204 includes a plurality of guide surfaces 222 extending inwardly from the opening 216. Specifically, the guide surfaces 222 are chamfered and extend toward the connector cavity 214 from the edges of the shroud 204 defining the opening 216. As such, the guide surfaces 222 act as a lead-in for mating the plug assembly 12 to the receptacle assembly 14.

Optionally, the shroud 204 may include a keying channel 224 which acts as a keying feature for guiding the plug assembly 12, and more specifically, to guide the keying post 140 (shown in FIG. 3) into position during mating of the plug assembly 12. The keying channel 224 is generally rectangular in shape and includes longitudinal and lateral side walls 226 and 228, respectively. Additionally, the keying channel 224 includes an opening 230 along the top portion of the keying channel 224. Chamfered edges 232 extend inwardly from the opening 230 and provide a lead-in for the keying post 140. Specifically, the chamfered edges 232 function as guide surfaces for the keying post 140, and provide an alignment window, or tolerance, during assembly and mating of the assemblies 12 and 14, as will be described in detail below.

The keying channel 224 is positioned along one of the longitudinal side wall 212 of the shroud 204. Additionally, the keying channel 224 extends above the guide surfaces 222. As such, the keying channel 224 interfaces with the keying post 140 prior to the guide surfaces 222 interfacing with the plug assembly 12. The opening 230 of the keying channel 224 is oriented such that the channel 224 is accessed from a similar direction as the opening 216 of the shroud 204. Moreover, the keying channel 224 is positioned outside of the footprint of the connectors 202, thus allowing for tighter stacking of the connectors 202 and corresponding shrouds 204. By positioning the keying channels 224 along the longitudinal side wall 212, the connectors 202 and corresponding shrouds 204 may be may be placed closer to one another. Specifically, the connectors 202 and corresponding shrouds 204 may be stacked in a side-by-side configuration such that the portion of the lateral side walls 210 below the ledges 218 abut one another. The portion of the lateral side walls 210 above the ledges 218 are spaced apart such that the ledges 218 of adjacent shrouds 204 support the retention plate 206 when the receptacle assembly 14 is assembled.

The retention plate 206 includes a body 240 having an inner surface 242 and an outer surface 244. A plurality of cutouts 246 extend through the body 240 in a side-by-side configuration from the inner surface 242 to the outer surface 244, and are sized and shaped to surround the portion of the shrouds 204 above the ledges 218. The cutouts 246 allow access to the connector 202 for mating with the plug assembly 12. In the illustrated embodiment, the retention plate 206 includes three cutouts 246 for insertion over three shrouds 204, however, as described above, the retention plate 206 may be used to retain more or less than three shrouds 204. As such, the retention plate 206 may include more or less than three cutouts 246 in alternative embodiments to accommodate different numbers of shrouds 204. Optionally, the retention plate 206 may include notched portions 248 to accommodate for the keying channel 224 of each shroud 204.

During assembly, the retention plate 206 is fitted over the shrouds 204. Additionally, the retention plate 206 is mechanically connected to the circuit board 18 with known fastener elements 250, such as screws. Specifically, the retention plate 206 includes fastener bores 252 extending between the inner and outer surfaces 242 and 244 which receive the fastener elements 250. Optionally, the fastener bores 252 may be substantially aligned with the fastener bores 220 of the shrouds 204, and the fastener elements 250 extend through both fastener bores 252 and 220 to couple the retention plate 206 to the circuit board 18.

In an exemplary embodiment, when the retention plate 206 is secured to the circuit board 18, the shrouds 204 are sandwiched between the retention plate 206 and the circuit board 18. Additionally, the inner surface 242 of the retention plate 206 engages the ledges 218 of the shrouds 204 and the outer surface 244 may be substantially coplanar with the openings 216 of the shrouds 204. By engaging the ledges 218, the retention plate 206 prevents movement of the shrouds 204 away from the circuit board 18. For example, the retention plate 206 may prevent movement in the direction of arrow A, arrow B, and/or arrow C. Moreover, by engaging the ledges 218 of multiple shrouds 204, the retention plate 206 can secure those shrouds 204 without the need of using a fastener element 250 for each shroud 204. In one embodiment, the retention plate 206 may retain, for example, five shrouds 204 using, for example, two fastener elements 250. Thus the overall assembly time and number of components used is reduced.

During use, the connector assembly 10 provides reliable interconnection of the receptacle assembly 14 and the plug assembly 12, including shielding and grounding of the components. Moreover, multiple connector assemblies 10 may be provided. Prior to mating the assemblies 12 and 14, each connector 202 is securely coupled to the circuit board 18. Specifically, each connector 202 is mounted to the circuit board 18 in a known manner. Once mounted, each connector 202 is covered by a single shroud 204 and the retention plate 206 secures multiple shrouds 204 to the circuit board 18. In an exemplary embodiment, the shrouds 204 and retention plate 206 are utilized to relieve forces and strains imposed on the connector 202 during insertion and/or removal of the plug assembly 12. However, the shrouds 204 and retention plate 206 may be utilized to secure the connectors 202 to the circuit board 18.

Additionally, the receptacle assembly 14 provides a guide system for mating the assemblies 12 and 14. In one embodiment, the receptacle assembly 14 provides a three stage guide system for mating the assemblies 12 and 14, as will be described in detail below. Specifically, the keying channel 224, the guide surfaces 222, and the contacts 208 interface with and substantially align the plug assembly 12, and more particularly the keying post 140 (shown in FIG. 2), the wafer holder 116 (shown in FIG. 2), and the wafers 102 (shown in FIG. 2), respectively, as the plug assembly 12 is mated to the receptacle assembly 14.

One stage of the guide system involves the keying post 140 interfacing with the keying channel 224 as the plug assembly 12 is mated with the receptacle assembly 14. Due to the chamfered surfaces on each of the post 140 and channel 224, a lead-in window is provided, and a predetermined misalignment of the assemblies 12 and 14 is tolerated. Specifically, the size or length of the chamfered surfaces defines the amount of misalignment tolerated. In one embodiment, the lead-in window is between approximately two and four millimeters, however, the size of the lead-in window may be greater or less depending on the particular application. Additionally, as the post 140 is fully inserted into the channel 224, the misalignment of the assemblies 12 and 14 may be substantially eliminated such that the wafers 102 of the plug assembly 12 are substantially aligned with the contacts 208 of the receptacle assembly 14.

Another stage of the guide system involves the guide surfaces 222 interfacing with the wafer holder 116 of the plug assembly 12. Specifically, due to the chamfered surface of the guide surface 222, a lead-in window is provided along the side walls 210 and 212 of the shroud 204. A predetermined misalignment of the assemblies 12 and 14 is tolerated, and in one embodiment, the lead-in window for the guide surface 222 is between approximately one and two millimeters, however, the size of the lead-in window may be greater or less depending on the particular application. However, as the wafer holder 116 is inserted into the shroud 204, the misalignment of the assemblies 12 and 14 may be substantially eliminated such that the wafers 102 (shown in FIG. 2) of the plug assembly 12 are substantially aligned with the contacts 208 of the connector 202. Additionally, the overall size of the shrouds 204, and particularly the size of the shrouds 204 in the longitudinal direction, is reduced due to the addition of the keying channel 224. Specifically, the keying channel 224 provides a larger alignment window, or a greater misalignment tolerance, than that provided by the guide surfaces 222. Alternatively, to provide a larger alignment window using the guide surfaces 222, the longitudinal width of the shroud 204 would increase. As a result of using the keying channels 224, and thus reducing the longitudinal width of the shroud 204, the connectors 202 and corresponding shrouds 204 may be more tightly stacked with respect to one another.

Another stage of the guide system involves the contacts 208 interfacing with the wafers 102. Specifically, the chamfered surfaces of the contacts 208 provide a lead-in window for the wafers 102 to interface with the contacts 208. A predetermined misalignment of the wafers 102 is tolerated, and in one embodiment, the lead-in window for the contacts 208 is between approximately one half and one millimeter.

As the plug assembly 12 is fully mated with the receptacle assembly 14 the wafers 102 provide interconnection of high-speed signals between the plug assembly 12 and the receptacle assembly 14. Additionally, the ground shield 108 (shown in FIG. 2), and more particularly the grounding tabs 132 (shown in FIG. 2), engage the conductive retention plate 206, thus forming an electrical connection therebetween. The retention plate 206 is electrically terminated into the circuit board 18, thus providing a grounding path between the cable 109 (shown in FIG. 2) connected to the plug assembly 12 and the circuit board 18. As such, the connector assembly 10 is shielded and grounded in a cost effective and reliable manner.

Moreover, once the assemblies 12 and 14 are mated, the mounting fasteners 126 of the plug assembly 12 may be inserted into the fastener bores 252 of the retention plate 206 to secure the plug assembly 12 to the receptacle assembly 14. Optionally, the mounting fasteners 126 may also be inserted into the fastener bores 220 of the shrouds 204 and tightened to secure the assemblies 12 and 14 together.

Figure 5:
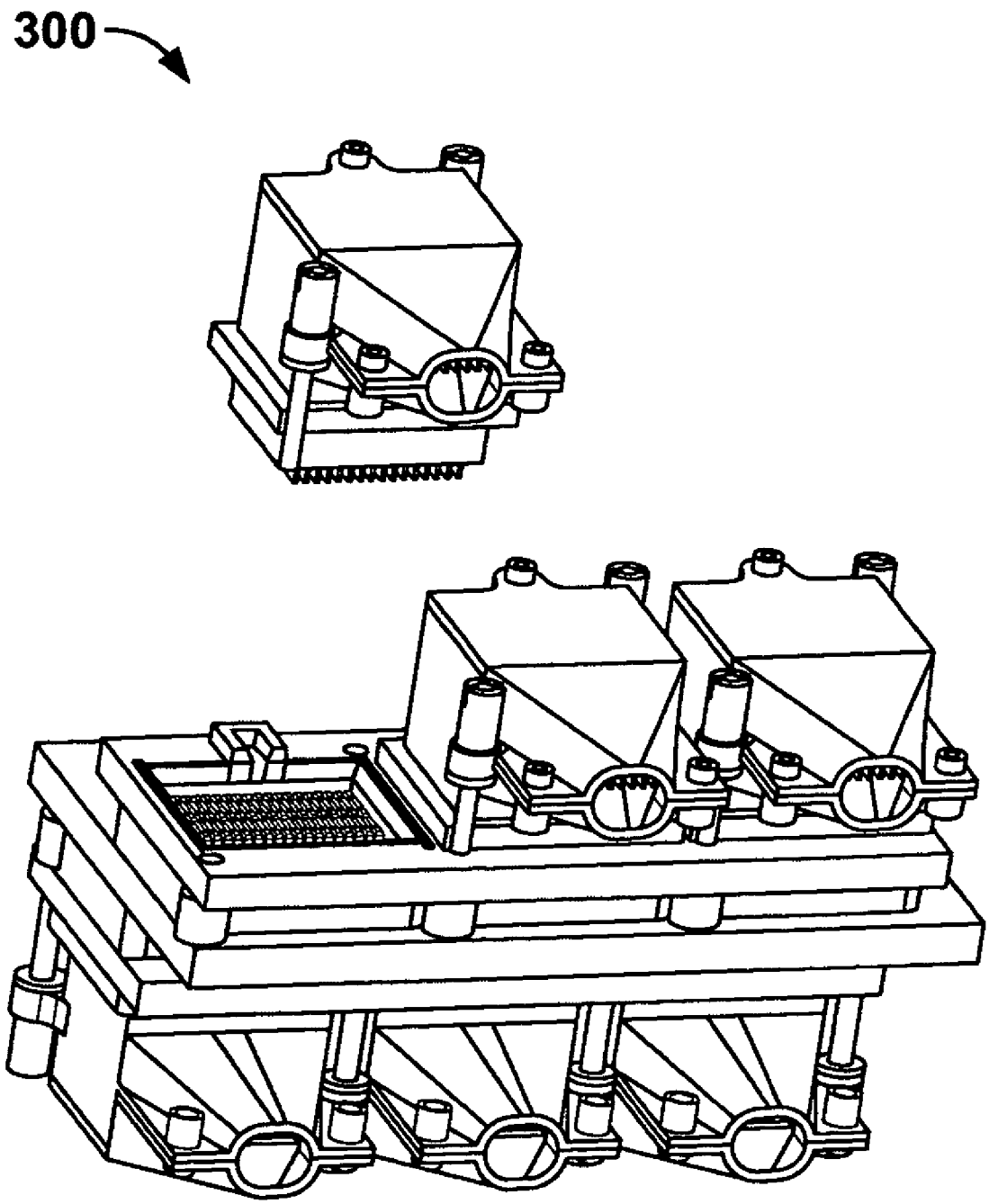
FIG. 5 is an assembled perspective view of an alternative cable connector assembly formed in accordance with an alternative embodiment of the present invention.

FIG. 5 is an assembled perspective view of an alternative cable connector assembly 300 formed in accordance with an alternative embodiment of the present invention. The connector assembly 300 differs from the connector assembly 10 illustrated in FIGS. 1–4 in that the connector assembly 300 does not include a keying post or a keying channel. As such, the amount of space occupied by the connector assembly 300 is reduced as compared to the connector assembly 10.

As such, the pick-up window, or tolerance, of the guide system is reduced. For example, the pick-up window for the connector assembly 300 may be, for example, between approximately one and two millimeters.

While the invention has been described in terms of various specific embodiments, those skilled in the art will recognize that the invention can be practiced with modification within the spirit and scope of the claims.

What is claimed is:

1. A connector assembly for mounting on a circuit board, comprising:

a plurality of electrical connectors arranged in a side-by-side configuration, each of said electrical connectors comprising a plurality of contacts defining a plug interface;

a plurality of shrouds separately provided from and surrounding said plurality of electrical connectors, each of said shrouds comprising an opening defined by a first guide surface and a second guide surface, said opening providing access to the plug interface of said plurality of contacts, each of said shrouds further comprising a keying channel extending from an exterior surface of each said shroud and defining a preliminary guide surface for a mating plug assembly; and a retention plate coupled to each of said plurality of shrouds for preventing movement of said shrouds with respect to said circuit board.

2. The connector assembly in accordance with claim 1 wherein each of said electrical connectors comprises a housing surrounding said contacts, and each of said shrouds engages a respective said housing.

3. The connector assembly in accordance with claim 1 wherein each of said first guide surface and said second guide surface comprises a chamfered surface.

4. The connector assembly in accordance with claim 1 wherein each of said first guide surface and said second guide surface are inwardly sloped from an outer edge of each said shroud.

5. An electronic package comprising:

a circuit board;

a receptacle assembly comprising a connector coupled to said circuit board and a shroud separately provided from said connector and surrounding said connector, said shroud having a preliminary guide surface and a secondary guide surface, said connector comprising a plurality of contacts defining a contact interface, said at least one guide surface proximate the contact interface;

a retention plate coupled to said shroud and retaining said shroud against said circuit board; and a plug assembly mounted to and engaging said receptacle assembly, said plug assembly comprising a plurality of wafers, a shell surrounding said wafers, and a ground shield coupled to said shell and engaging said retention plate when said plug assembly is mounted to said receptacle assembly, each said wafer comprising a contact interface for engaging said plurality of contacts when said plug assembly is mounted to said receptacle assembly.

6. The connector assembly in accordance with claim 5 wherein said secondary guide surface is inwardly sloped from an outer edge of said shroud to define a mating window and to accommodate a predetermined amount of misalignment of said plug assembly.

7. The connector assembly in accordance with claim 5 wherein each of said primary and secondary guide surface comprises a chamfered surface defining a guide window to accommodate a predetermined amount of misalignment of said plug assembly.

8. The connector assembly in accordance with claim 5 wherein said plug assembly further comprises a keying post extending from an exterior surface of said shell, said preliminary guide surface comprising a keying channel, said keying post mating with said keying channel to align said plug assembly with said connector prior to each of said contact interfaces engaging said plurality of contacts.

9. The connector assembly in accordance with claim 5 wherein said receptacle assembly comprises a plurality of connectors arranged in a side-by-side configuration and a plurality of shrouds separately provided from and surrounding said plurality of connectors, said retention plate coupled to each of the plurality of shrouds.

* * * * *